US011109699B2

(12) United States Patent
Suprina

(10) Patent No.: US 11,109,699 B2
(45) **Date of Patent: *Sep. 7, 2021**

(54) CONVERTIBLE BEVERAGE CONTAINER AND DRINKING APPARATUS

(71) Applicant: Scott F. Suprina, E. Northport, NY (US)

(72) Inventor: Scott F. Suprina, E. Northport, NY (US)

( * ) Notice: Subject to any disclaimer, the term of this patent is extended or adjusted under 35 U.S.C. 154(b) by 286 days.

This patent is subject to a terminal disclaimer.

(21) Appl. No.: 16/104,538

(22) Filed: Aug. 17, 2018

(65) Prior Publication Data

US 2019/0008296 A1 Jan. 10, 2019

Related U.S. Application Data

(63) Continuation-in-part of application No. 15/361,988, filed on Nov. 28, 2016, now Pat. No. 10,455,958,
(Continued)

(51) Int. Cl.
*A47G 19/22* (2006.01)
*B65D 85/72* (2006.01)
(Continued)

(52) U.S. Cl.
CPC ..... *A47G 19/2255* (2013.01); *B65D 1/02* (2013.01); *B65D 1/023* (2013.01); *B65D 1/0261* (2013.01);
(Continued)

(58) Field of Classification Search
CPC ..... A47G 19/2255; B65D 11/04; B65D 1/02; B65D 1/023; B65D 1/0261; B65D 1/40
See application file for complete search history.

(56) References Cited

U.S. PATENT DOCUMENTS

| | | | | |
|---|---|---|---|---|
| 640,860 | A | 1/1900 | Baum, Jr. | |
| 2,086,404 | A | 7/1937 | Daniels | |
| 6,164,473 | A | 12/2000 | Waldrip | 215/378 |
| 6,662,959 | B1 | 12/2003 | Westerhold | 215/378 |
| 6,905,038 | B2 | 6/2005 | Lopez | 215/228 |
| 7,467,726 | B1 | 12/2008 | Izraelev | 215/396 |

(Continued)

FOREIGN PATENT DOCUMENTS

| | | | | |
|---|---|---|---|---|
| WO | WO-9834846 A1 * | 8/1998 | | B65D 41/045 |
| WO | WO-2017019379 A1 * | 2/2017 | | H04W 4/021 |
| WO | WO-2017109379 A1 * | 6/2017 | | B65D 51/2878 |

OTHER PUBLICATIONS

Extended European Search Report for Application No. 20154176.0, dated Apr. 9, 2021 (7 pages).

*Primary Examiner* — Ibrahime A Abraham
*Assistant Examiner* — Dilnessa B Belay
(74) *Attorney, Agent, or Firm* — Nutter McClennen & Fish LLP

(57) ABSTRACT

A convertible beverage container includes a first pod portion, a second pod portion, and at least one seal. The first and second pod portions are configured to alternately form (a) a pod configuration in which a base element at a base end of the first pod portion is fixably attached to an open orifice at a drinking end of the second pod portion with the at least one seal disposed between the first and second pod portions to form a seal therebetween and (b) a stemware configuration in which an attachment element at an attachment end of the first pod portion is fixably attached to an attachment region of the second pod portion to form a stemware drinking vessel having a foot, a stem, and a bowl in which the first pod portion forms the foot and stem of the stemware drinking vessel and the second pod portion forms the bowl of the stemware drinking vessel.

26 Claims, 13 Drawing Sheets

Related U.S. Application Data which is a continuation of application No. 13/713,575, filed on Dec. 13, 2012, now Pat. No. 9,504,341.

(51) Int. Cl.

| | |
|---|---|
| ***B65D 81/32*** | (2006.01) |
| ***B65D 1/02*** | (2006.01) |
| ***B65D 8/00*** | (2006.01) |
| ***B65D 1/40*** | (2006.01) |

(52) U.S. Cl.

CPC ..... *B65D 1/40* (2013.01); *B65D 11/04* (2013.01); *B65D 81/3205* (2013.01); *B65D 85/72* (2013.01); *Y10T 29/49716* (2015.01); *Y10T 29/49826* (2015.01)

(56) References Cited

U.S. PATENT DOCUMENTS

| | | | | |
|---|---|---|---|---|
| 7,770,748 | B2 | 8/2010 | Elliott | 220/212 |
| 7,775,393 | B1 | 8/2010 | Feldman et al. | 220/709 |
| 8,196,764 | B2 | 6/2012 | Bernstein | 215/377 |
| 2002/0153344 | A1 | 10/2002 | Pola | |
| 2005/0092760 | A1* | 5/2005 | Westerhold | A47G 19/2255 220/703 |
| 2005/0155974 | A1 | 7/2005 | Amron | |
| 2006/0273087 | A1 | 12/2006 | Crawford | |
| 2008/0011748 | A1 | 1/2008 | Meyer | |
| 2010/0163559 | A1* | 7/2010 | Towers | B65D 51/20 220/254.1 |
| 2012/0233968 | A1 | 9/2012 | Bernstein | 53/452 |
| 2017/0071378 | A1* | 3/2017 | Suprina | B65D 81/3205 |

* cited by examiner

CONVERTIBLE BEVERAGE CONTAINER AND DRINKING APPARATUS

CROSS-REFERENCE TO RELATED APPLICATION(S)

This patent application is a continuation-in-part of, and therefore claims priority from, U.S. patent application Ser. No. 15/361,988 entitled CONVERTIBLE BEVERAGE CONTAINER AND DRINKING APPARATUS AND METHOD OF MANUFACTURING filed Nov. 28, 2016, which is continuation of, and therefore claims priority from, U.S. patent application Ser. No. 13/713,575 entitled CONVERTIBLE BEVERAGE CONTAINER AND DRINKING APPARATUS AND METHOD OF MANUFACTURING filed Dec. 13, 2012 (U.S. Pat. No. 9,504,341), each of which is hereby incorporated herein by reference in its entirety.

FIELD OF THE INVENTION

The present invention relates generally to beverage containers, more particularly to a convertible beverage container and drinking apparatus that contains a beverage or one or more ingredients for a beverage and converts to a stemware-type drinking vessel.

BACKGROUND OF THE INVENTION

As is generally known, alcohol is a controlled substance that is highly regulated. To bottle alcohol generally requires substantial regulatory compliance. As a result, distillers often perform their own bottling and they focus their operations on a few alcoholic products that they sell. This regulatory and market constraint limits the choice of beverages and container alternatives to consumers.

In some cases, it may be necessary or desirable to quickly dispense alcoholic beverages, particularly mixed drinks, in a confined space while offering wide varieties of alternatives to consumers. For example, airlines serve alcoholic beverages on airplanes and stadium concession-stands serve alcoholic beverages during sporting events in single sized servings. Alcoholic beverages may be served at concession stands at concerts, theme parks, and other types of events. In such scenarios, servers generally need to distribute beverages to a large number of consumers in a rapidly-moving and chaotic environment, which can be difficult to do if the server needs to mix a drink or compile various ingredients (e.g., alcohol and a mixer) together with a cup or glass to distribute to the consumer.

There is a need to provide easily-dispensable beverages that offers wide-varieties of choices to consumers.

SUMMARY OF EXEMPLARY EMBODIMENTS

In accordance with one aspect of the invention there is provided a convertible beverage container and drinking apparatus comprising a first pod portion configured to secure a bottom end of a container and form a wider base for the container and a second pod portion configured to removably attach to the first pod portion, the second pod portion having an open orifice at a drinking end and an attachment region oppositely disposed to the drinking end, the attachment region configured to fixably engage to a mouth end of the container to form a stemware drinking vessel in which the first pod portion forms the foot of the stemware drinking vessel, the container forms the stem of the stemware drinking vessel, and the second pod portion forms the bowl of the stemware drinking vessel.

In various alternative embodiments, the convertible beverage container and drinking apparatus may further include a container secured to the first pod portion, wherein the container contains a beverage or an ingredient for a beverage. For example, the container may be a nip bottle containing alcohol. Alternatively, the container may be another type of container and may contain a liquid, powder, or other substance. The container may be made of virtually any material, such as glass, plastic, or metal. The first pod portion may fixably attach to the base end, for example, by press-fit, adhesive, indentation, ultrasonic welding, or heat fusion.

The first pod portion and the second pod portion generally form a pod when the first and second pod portions are attached to one another. The second pod portion may be configured to fixably attach to the first pod portion, for example, by a screw-fit, a press-fit, a snap-fit, or a locking tab. The first and second pod portions are typically made of plastic but alternatively may be made from other materials. The attachment region of the second pod portion may be threaded to fixably engage to the mouth end of the container.

The second pod portion may (and typically does) have a volume greater than the container, e.g., to allow the second pod portion to hold the contents of the container plus one or more additional ingredients such as for a mixed drink, and/or to mix a beverage. The second pod portion may contain an ingredient for a beverage, such as, for example, a mixer such as soda, juice, etc. The second portion may include a removable seal to hold the ingredient in the second pod portion. Additionally or alternatively, the first pod portion may include a hollow cavity containing at least one of (1) an ingredient for the beverage, (2) a drink-related article, or (3) a sanitary-related article. The second pod portion may be shaped as the bowl section of a glass used for a specific type of mixed drink, for example, based on an ingredient contained in the second pod portion or based on the contents of the container. In some embodiments, the second pod portion may be shaped as an ornament.

In accordance with another aspect of the invention there is provided a method of manufacturing a convertible beverage container and drinking apparatus. The method involves providing a base cover member configured to accommodate a base end of a container, the base cover member forming a wider base thereof, and attaching a bowl member to the base cover member to form a closed pod, the bowl member having an open orifice at a drinking end and an attachment region oppositely disposed to the drinking end, the attachment region being configured to fixably engage to a mouth end of the container to form a stemware drinking vessel in which the first pod portion forms the foot of the stemware drinking vessel, the container forms the stem of the stemware drinking vessel, and the second pod portion forms the bowl of the stemware drinking vessel.

In various alternative embodiments, the method may further involve attaching the base end of a container to the base cover member. The container typically contains a beverage or an ingredient for a beverage and may be, for example, a nip bottle containing alcohol for an alcoholic beverage.

In accordance with yet another aspect of the invention there is provided a method of converting a convertible beverage container to a stemware drinking vessel, the convertible beverage container having a pod fixably attached to a container, the pod having a first pod portion and a second pod portion removably attached thereto, the second pod portion having an open orifice at a drinking end and an attachment region oppositely disposed to the drinking end, the attachment region configured to fixably engage to a mouth end of the container. The method involves disengaging the second pod portion from the first pod portion and fixably engaging the attachment region of the second pod portion to the mouth end of the container to form the stemware drinking vessel in which the first pod portion forms the foot of the stemware drinking vessel, the container forms the stem of the stemware drinking vessel, and the second pod portion forms the bowl of the stemware drinking vessel.

In various alternative embodiments, the container typically contains a beverage or an ingredient for a beverage (e.g., the container may be a nip bottle containing alcohol for an alcoholic beverage), and the method may further involve, prior to fixably engaging the attachment region of the second pod portion to the mouth end of the container, opening the container and pouring the beverage or ingredient for the beverage into the second pod portion. The second pod portion may include an ingredient for the beverage (e.g., a mixer such as soda or juice) and may include a removable seal to hold the ingredient in the second pod portion, and the method may further involve removing the seal prior to pouring the beverage or ingredient for the beverage from the container into the second pod portion.

Additional embodiments may be disclosed and claimed.

BRIEF DESCRIPTION OF THE DRAWINGS

The foregoing features of embodiments will be more readily understood by reference to the following detailed description, taken with reference to the accompanying drawings, in which.

It should be noted that the foregoing figures and the elements depicted therein are not necessarily drawn to consistent scale or to any scale. Unless the context otherwise suggests, like elements are indicated by like numerals.

DETAILED DESCRIPTION OF SPECIFIC EMBODIMENTS

As used herein, the term "convertible" refers to an apparatus being changed from one use or tangible form to another.

As used herein, the term "fixably attached" refers to two components that are attached so that they remain together either permanently or temporarily (e.g., until they are expressly disengaged).

In exemplary embodiments, a convertible drinking vessel (referred to herein for convenience as a "pod") is configured to hold an otherwise separate container containing a beverage or ingredient for a beverage (such as a nip bottle of alcohol) in such a way that the pod with container can be distributed as a unit and is convertible to a stemware-type drinking vessel in which a top portion of the pod that secures the container becomes the foot of the stemware, the container becomes the stem of the stemware, and a bottom portion of the pod (which optionally may be pre-packaged with an ingredient for a mixed beverage, such as a liquid or powder mixer) can be attached to the top of the container to become the bowl of the stemware.

Generally speaking, in order to use the pod for preparing and/or drinking a beverage, the consumer would separate the bottom portion of the pod from the top portion, open the container, pour some or all of the contents of the container into the bottom portion (which optionally may contain an ingredient for a mixed drink, such as soda, juice, or other mixer), and then attach the bottom portion to the opened end of the container to form the stemware drinking vessel. Since the pod with container can be distributed as a unit, distribution should be much faster than, say, distributing separate drink components. As a result, it is expected that more beverages can be distributed in a shorter amount of time, which, for example, can reduce the amount of time a consumer needs to wait in line for a beverage and hence may increase overall sales as people who otherwise might have avoided purchasing a beverage due to a long or slow-moving line now might choose to purchase the beverage due to a short or fast-moving line. This may be particularly advantageous during intermissions of an event, such as, for example, between quarters of a football or basketball game, between periods of a hockey game, between innings of a baseball game, at intermissions of a concert or play, etc. Also, since the pod with container can be distributed as a unit, it should be easier for vendors on foot to carry and dispense mixed drinks, such as in the stands of sporting events where mixed drinks often are not currently served.

Figure 1A:
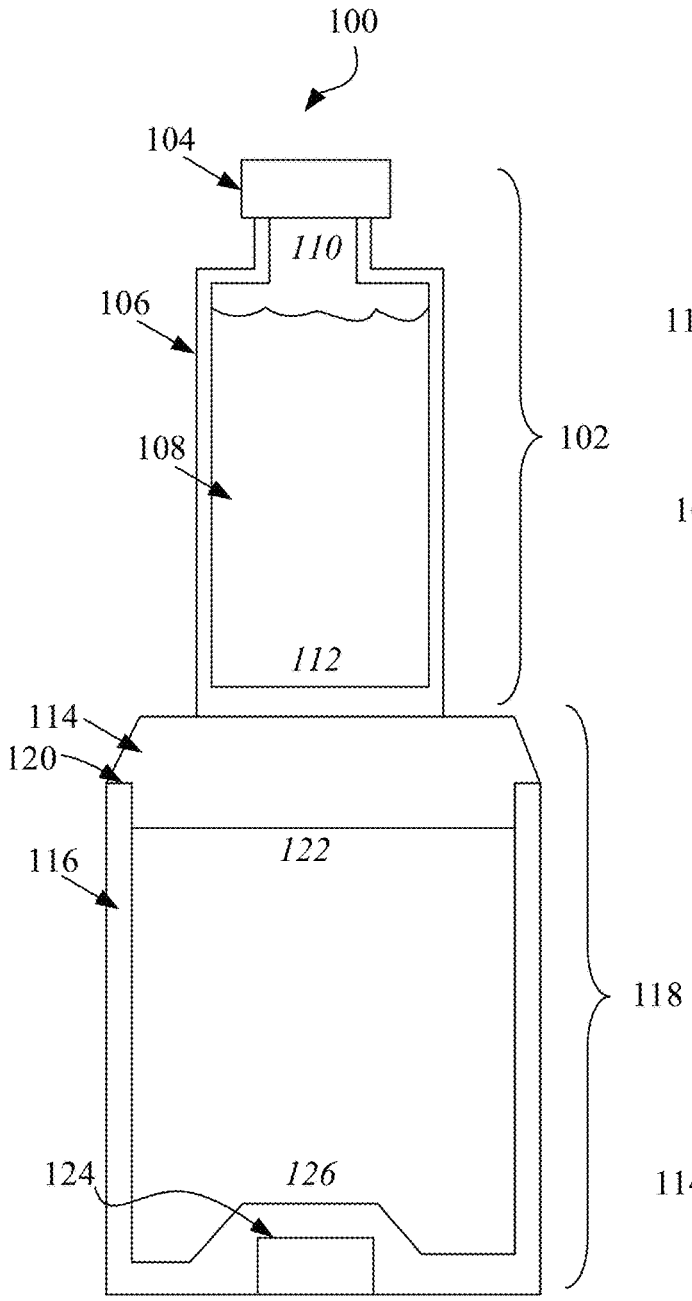
FIG. 1A schematically shows a cross-sectional view of a convertible beverage container and drinking apparatus in an initial pre-packaged form for storage and dispensing.

FIG. 1A schematically shows a cross-sectional view of a convertible beverage container and drinking apparatus 100 in an initial pre-packaged form for storage and dispensing. The apparatus 100 includes a container 102 that is typically pre-packaged with an ingredient 108 for a beverage, such as a liquid (e.g., alcohol), powder, or other form of ingredient. In the illustrative embodiment, the container 102 may be a small bottle (e.g., a nip bottle) that has been pre-packaged with an ingredient such as liquor, although the container 102 can be other types of containers, such as, for example, a small can. The container 102 may be made of any material, such as plastic or glass or metal. In this illustrative embodiment, the container 102 has a top-mouth end 110, an elongated body 106, and a bottom-base end 112 oppositely disposed to the top-mouth end 110. The mouth end 110 forms an orifice, which is sealed by a sealing cap 104. The sealing cap 104 is fixably engaged to mouth end 110, such as by means of a twist-off cap, a cork, or a locking tab, which are configured to be removed during use.

The apparatus 100 also includes a pod 118 having a first pod portion 114 fixably attached to the base end 112 of the container 102. The first pod portion 114 forms a wider base for the container 102 than the base end 112 and extends from the base end 112. The first pod portion 114 may fixably attach to the base end 112, at the bottom thereof, and may be held by at least one of press-fit, adhesives, indentation, ultrasonic welding, and heat fusion. According to one exemplary embodiment, the first pod portion 114 is configured for simple attachment (to be discussed) to the container 102, such as by press-fitting the container 102 into a receptacle in the first pod portion 114.

The apparatus 100 also includes a second pod portion 116 fixably attached to the first pod portion 114 to form a closed pod 118. The second pod portion 116 and first pod portion 114 are configured to disengage from one another. The second pod portion 116 includes an elongated body having a drinking orifice 120 at the top-drinking end 122 and an attachment region 124 at the bottom end 126 oppositely disposed to the drinking end 122. The attachment region 124 is configured to fixably engage to the container 102. According to one exemplary embodiment, the attachment region 124 can be fixably engaged to the top-mouth end 110 of the pre-packaged fluid container 102 after the sealing cap 104 is removed. The attachment region 124 may be configured to seal the container 102. In an alternate embodiment, the attachment region 124 may be fixably engaged to the sealing cap 104 of the pre-packaged fluid container 102.

To provide easily-dispensable and pre-packaged mixed alcoholic beverages, a server or vendor may readily dispense pre-packaged beverages in apparatus 100, as shown in FIG. 1A.

Figure 1B:
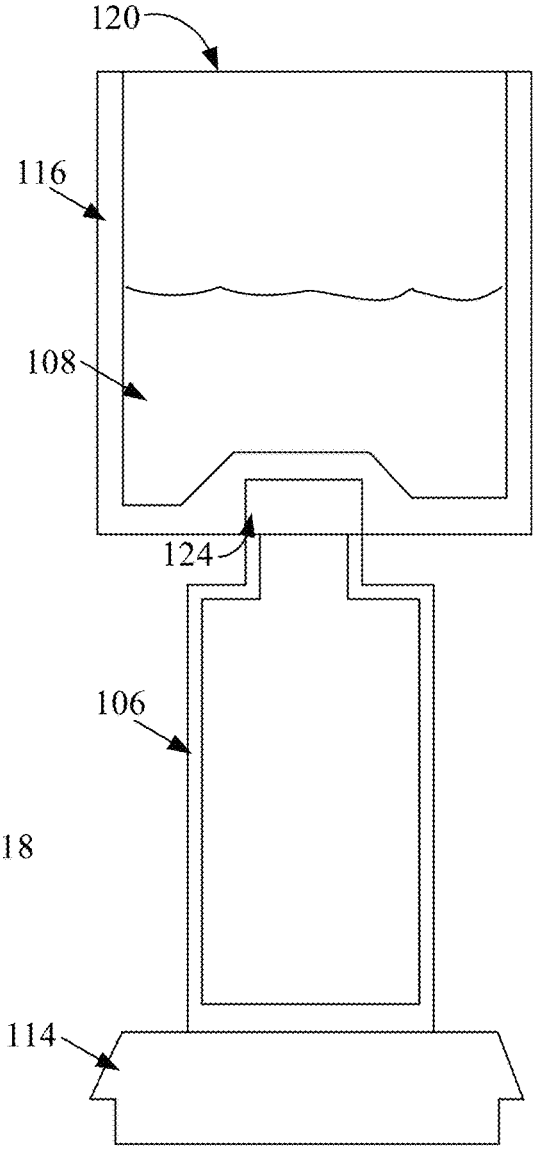
FIG. 1B schematically shows a cross-sectional view of the convertible beverage container and drinking apparatus of FIG. 1A in a converted form.

FIG. 1B schematically shows a cross-sectional view of the convertible beverage container and drinking apparatus 100 of FIG. 1A in a converted form. To prepare the beverage for consumption, a consumer would disengage the second pod portion 116 from the first pod portion 114. The consumer then opens the container 102 by removing the sealing cap 104 and pours some or all of the contents 108 into the second pod portion 116 (which may contain a mixer as discussed below). The consumer may then attach the second pod portion 116 to the top-mouth end 110 of the container 102. The resulting converted drinking apparatus is shown in FIG. 1B and essentially forms an article of stemware in which the first pod portion 114 forms the foot of the stemware, the container 102 forms the stem, and the second pod portion 116 forms the bowl.

The second pod portion 116 typically has a volume greater than that of the container 102 (e.g., at least twice the volume). This larger volume may accommodate additional ingredients to be added to make the mixed drinks as well as for mixing.

Alternatively, for certain type of mixed drinks, the apparatus 100 may be configured to allow the first pod portion 114 to fixably attach to and disengage from the second pod portion 116 multiple times. In such configuration, the consumer may first disengage the first and second pod portions 114, 116 to allow for the ingredient 108 and other ingredients to be poured therein. Subsequently, the first and second pod portions 114, 116 may be reengaged to allow the consumer to mix a cocktail beverage by shaking the engaged pod portions.

The first and second pod portions 114, 116 may be made of the same material, such as a thermoplastic, or glass. It should be apparent that various types of plastic materials may be used, including, for example, high density polyethylene, low density polyethylene, polyethylene terephthalate, polyvinyl chloride, polypropylene, or polystyrene.

The apparatus 100 may be configured to provide great flexibility. In some embodiments, the apparatus 100 may be configured with topographical features to allow for easy attachment of the container 102 with the first pod section 114.

Figure 2A:
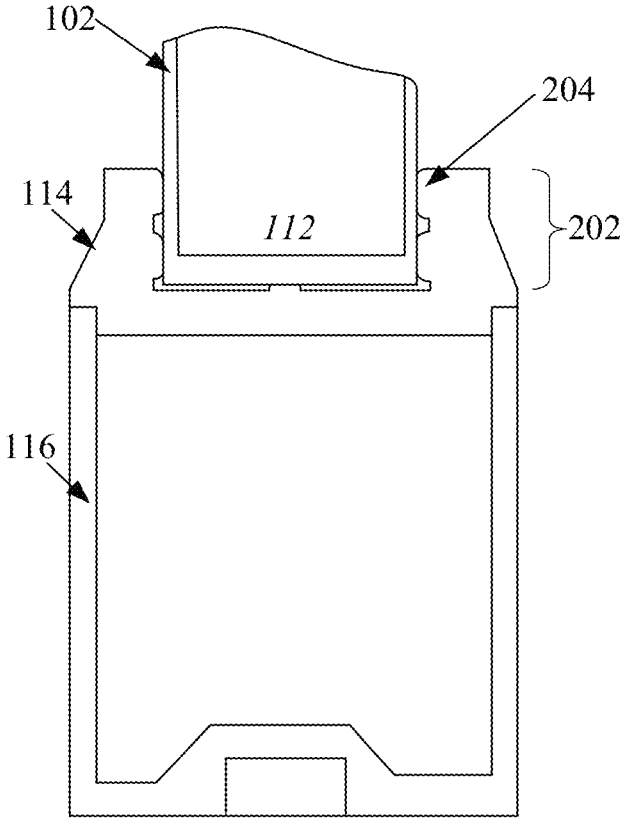
FIG. 2A schematically illustrates a cross-sectional view of the first pod portion with a press-fit recess to accommodate a pre-packaged fluid container.

FIG. 2A schematically illustrates the first pod portion 114 with a press-fit recess 202 to accommodate a container 102. Here, the first pod portion 114 has a recess 202 that is configured to fit the base end 112 of the container 102. The recess 202 may have a plurality of fins 204 to protrude into the recess 202 to provide the press-fit contact. The fins 204 may be compliant in that they may have certain elasticity characteristic to allow a container 102 to fit into the recess 202 while providing sufficient rigidity to frictionally secure the container 102.

Figure 2B:
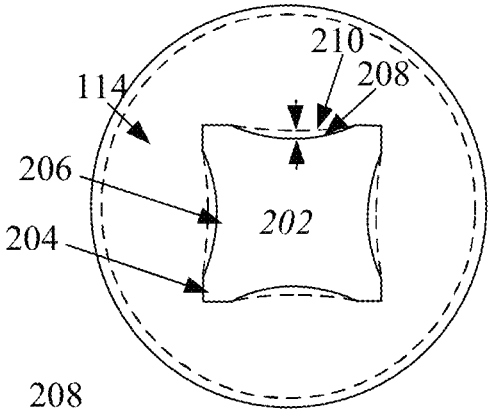
FIGS. 2B-E schematically show various embodiments of the first pod portion with different recess shapes.

FIG. 2B-E schematically show various alternative embodiments of the first pod portion 114 with different recess shapes to form a press-fit to accommodate variously shaped containers 102. In FIG. 2B, the first pod portion 114 is schematically shown having a recess 202 that is generally square 206. The recess 202 may have fins 204 located circumferentially therein. The fins 204 may be compliant to the container 102 placed within the recess 202. Here, being compliant refers to being able to vary or deform from an initial position 208 to a complied position 210.

The fins 204 may comply to form the press-fit with the base-end 112 of the container 102. Alternatively, the walls of the recess 202 may be made sufficiently thin to allow for it to flex when the container 102 is placed within the recess 202. Accordingly, both the fins 204 and the walls may deform to form the press-fit with the base-end 112 of the container 102.

Figure 2C:
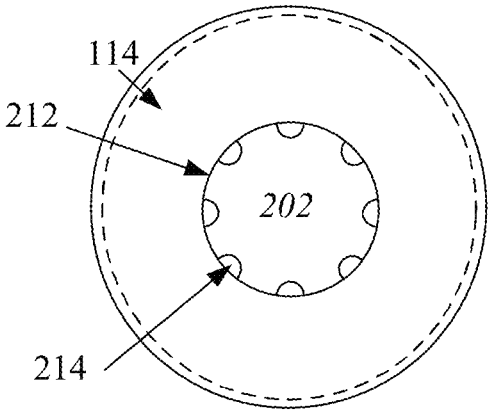

FIG. 2C schematically illustrates an alternate recess shape in the first pod portion 114. Here, the recess 202 is generally circular 212 and may accommodate a circular-shaped container 102. The circular shaped recess 212 may have fins 214 located circumferentially along its inner perimeter.

Figure 2D:
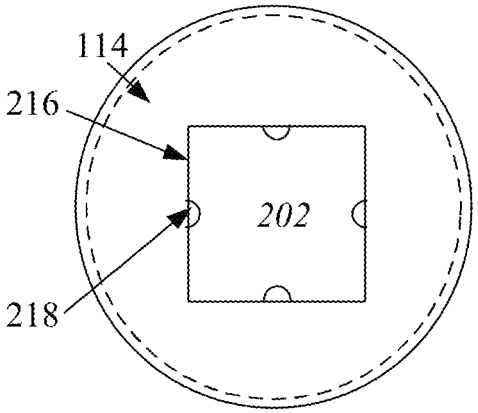

FIG. 2D schematically illustrates another alternate recess shape in the first pod portion 114. Here, the recess 202 is generally a square 216 and may accommodate a square shaped container 102. The square shaped recess 216 may have fins 218 located along its inner perimeter.

Figure 2E:
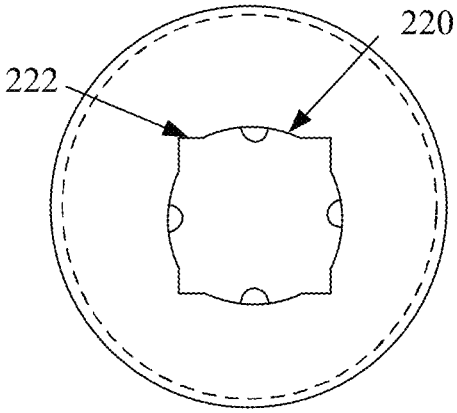

FIG. 2E schematically illustrates another alternate recess shape in the first pod portion 114. Here, the recess 202 includes a circular component 220 and square component 222 to accommodate either a square shaped or circular shaped container 102, such as to allow this configuration of first pod portion 114 to be used with certain different types of containers 102 (e.g., different sizes, shapes, types, brands, etc.).

It should be apparent to those skilled in the art that the various recess shapes provided are merely illustrative to show a press-fit contact between the first pod portion 114 and the base-end 112 of the container 102. The recess shapes may be configured to accommodate various alternate shapes of the base-end of the containers.

Figure 3A:
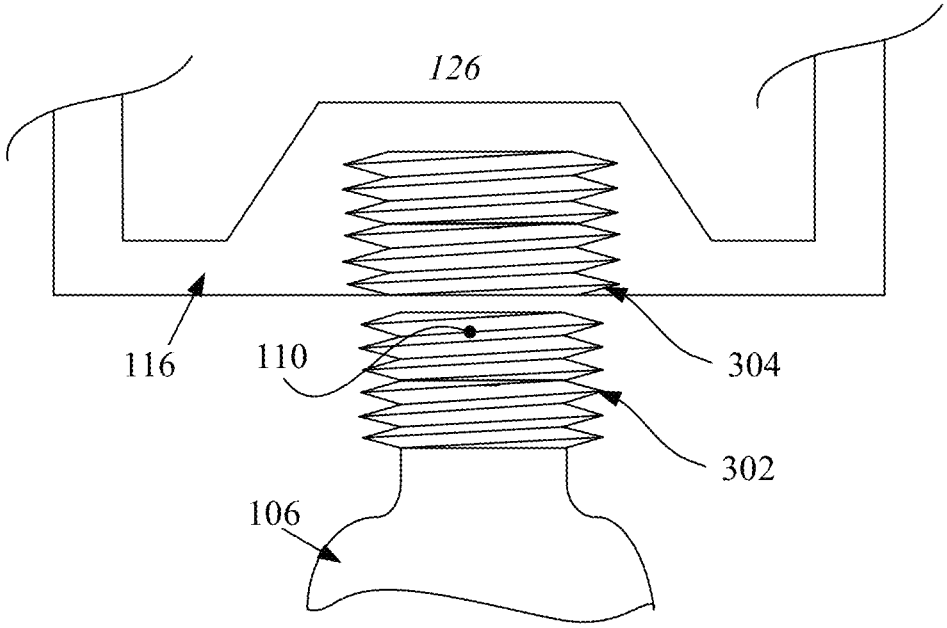
FIGS. 3A-B schematically illustrate various configurations of the attachment region of the second pod portion.
Figure 3B:
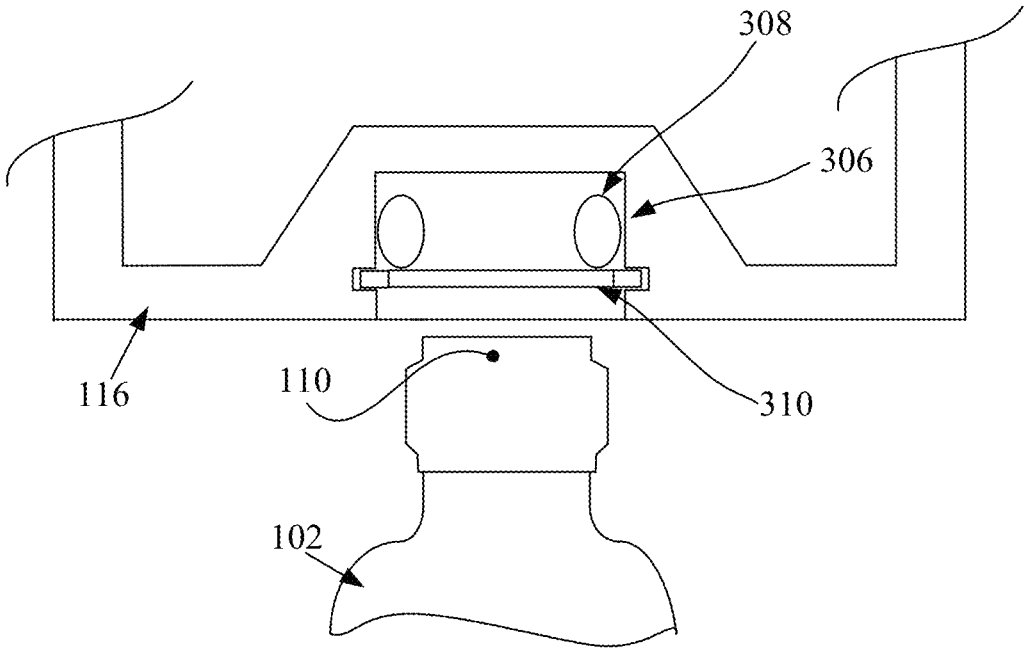

FIGS. 3A-B schematically illustrate various configurations of the attachment region 124 of the second pod portion. The attachment region 124 may fixably attach to the container 102 by any of various mechanisms, such as, for example, pressure-fit, recess screw, locking tab, or recess with a compliant gasket. FIG. 3A schematically illustrates the attachment region 124 as a recess screw 304. Where the top-mouth end 110 of the container 102 is a screw 302, the attachment region 124 may be shaped as a corresponding screw recess 304 at the bottom end 126 of second pod portion 116, including a threaded protrusion.

FIG. 3B schematically illustrates the attachment region 124 as a recess 306 with a compliant gasket 308. The compliant gasket 308 may have, for example, a round, rectangular, or oval cross section. In this exemplary embodiment, the compliant gasket 308 is placed in the recess 306 and retained in placed with a retaining ring 310. The recess 306 and compliant gasket 308 provides a pressure-fit engagement with the mouth end 110 of the container 102.

Alternatively, the attachment region may include a locking tab to engage with the mouth end 110 of the container 102.

Figure 4A:
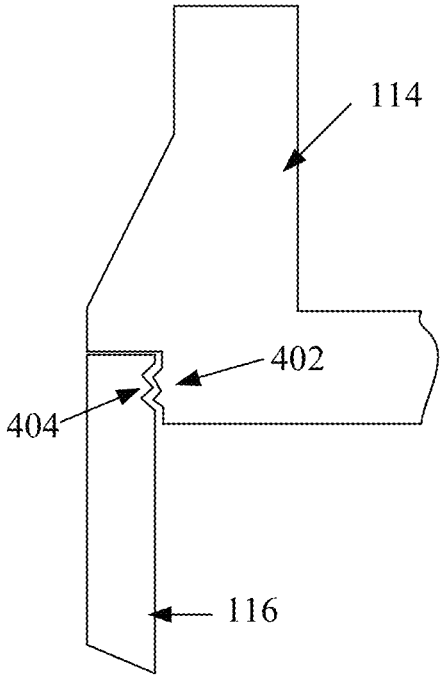
FIGS. 4A-C schematically illustrate various types of fixably attaching mechanisms between the first pod portion and the second pod portion.
Figure 4B:
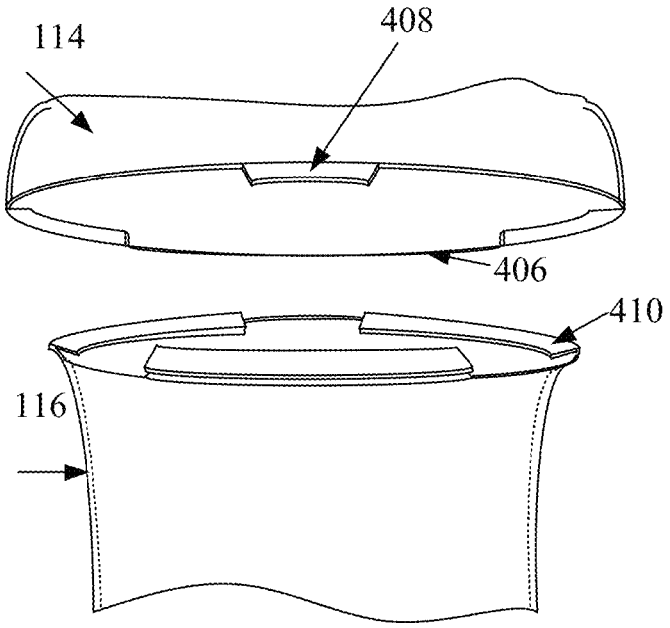
Figure 4C:
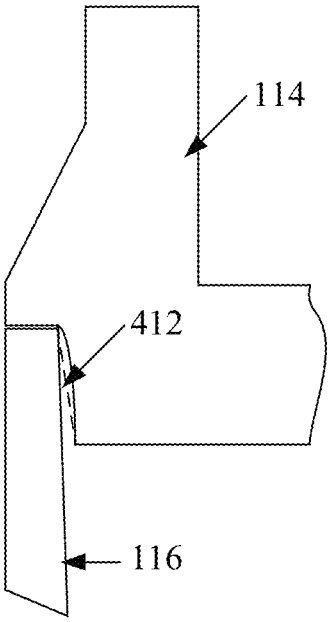

The first pod portion 114 or the second pod portion 116 may be configured to be fixably attached to one another by any of various mechanisms, such as a pressure-fit, a screw-fit, a snap-fit, or a locking tab. FIG. 4A-C schematically illustrate various types of fixably attaching mechanisms between the first pod portion 114 and the second pod portion 116. In FIG. 4A, a cross-sectional view of a schematic assembly of the first pod portion 114 being fixably attached to the second pod portion 116 by a screw-fit is shown. The first pod portion 114 has a first retaining screw portion 402 and the second pod portion 116 has a second retaining screw portion 404. The first retaining screw portion 402 corresponds to the second retaining screw portion 404.

FIG. 4B schematically illustrates the first pod portion 114 being fixably attached to the second pod portion 116 by a locking tab assembly. Here, the first pod portion 114 forms a mounting ring 406 having a set of retaining tabs 408. The second pod portion 116 forms a corresponding retaining tab 410. The tabs 408, 410 may align the first pod portion 114 and the second pod portion 116 during assembly. Either the first pod portion 114 or the second pod portion 116 may include the retaining component with the corresponding pod portion having the corresponding retaining component.

FIG. 4C schematically illustrates the first pod portion 114 being fixably attached to the second pod portion 116 by press-fit. Here, the first pod portion 114 may include an angled cross section 412 that is configured to deform or comply (shown in dash lines) to the second pod portion 116. As a result, as the second pod portion 116 is inserted into the first pod portion 114, the angled cross section 412 wedges against the inner mouth part of the second pod portion 116 to form the press-fit.

It should be noted that the present invention is not limited to any particular way for fixably attaching the first and second pod portions.

Figure 5A:
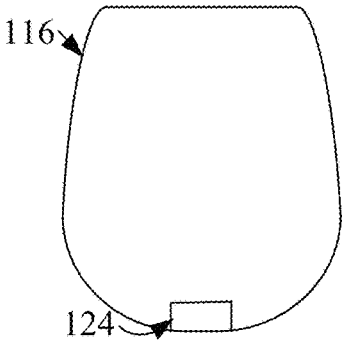
FIGS. 5A-I schematically illustrate various shapes of the second pod portion.
Figure 5B:
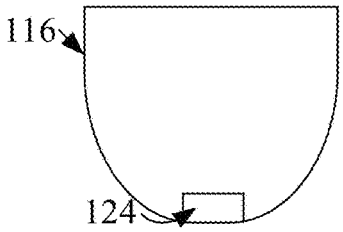
Figure 5C:
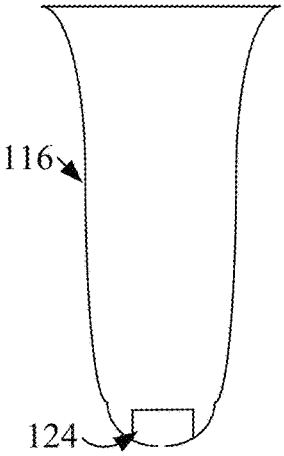
Figure 5D:
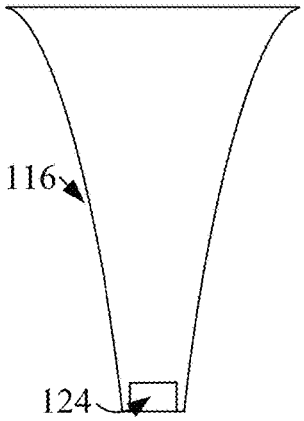
Figure 5E:
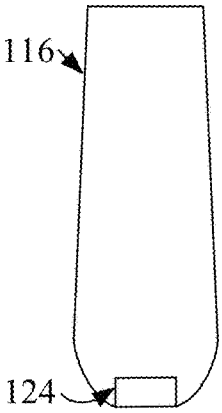
Figure 5F:
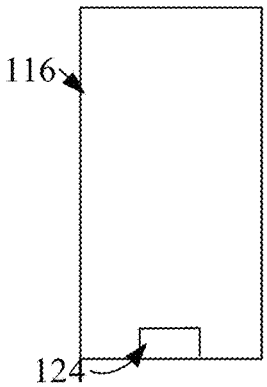
Figure 5G:
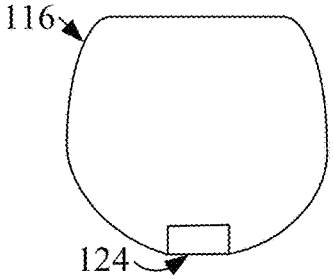
Figure 5H:
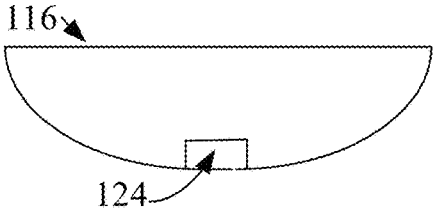
Figure 5I:
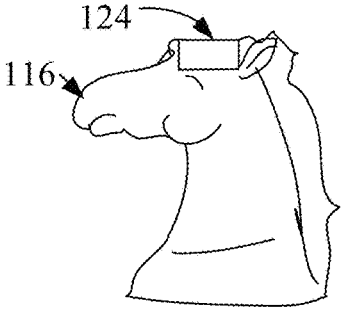

In various alternative embodiments, the second pod portion 116 may be shaped as any of various types of drinking vessels, e.g., so that the shape of the drinking vessel matches the type of beverage being consumed (e.g., shaped like a margarita glass for margarita beverages, shaped like a martini for martini beverages, etc.). FIGS. 5A-I schematically illustrate, without limitation, various possible shapes of the second pod portions 116. For example, the second pod portions may be shaped as a bowl portion of a wine glass (FIG. 5A and FIG. 5B), a cocktail glass (FIG. 5C and FIG. 5D), a champagne flute (FIG. 5E), a polygonal shaped glass (FIG. 5F), a brandy glass (FIG. 5G), or a martini glass (FIG. 5H). Of course, the second pod portion 116 may be shaped like other types of drinking vessels, such as, for example, margarita glass, hurricane glass, etc. Alternatively, the second pod portion 116 may be decoratively shaped in other ways, such as parts of animals or people. FIG. 5I illustrates the second pod portion 116 shaped as part of an animal. Here, a horse head is shown. It should be apparent that various shaped themes may be employed, such as sports equipment, celebrity faces, airplanes, company logos, etc.

Figure 6:
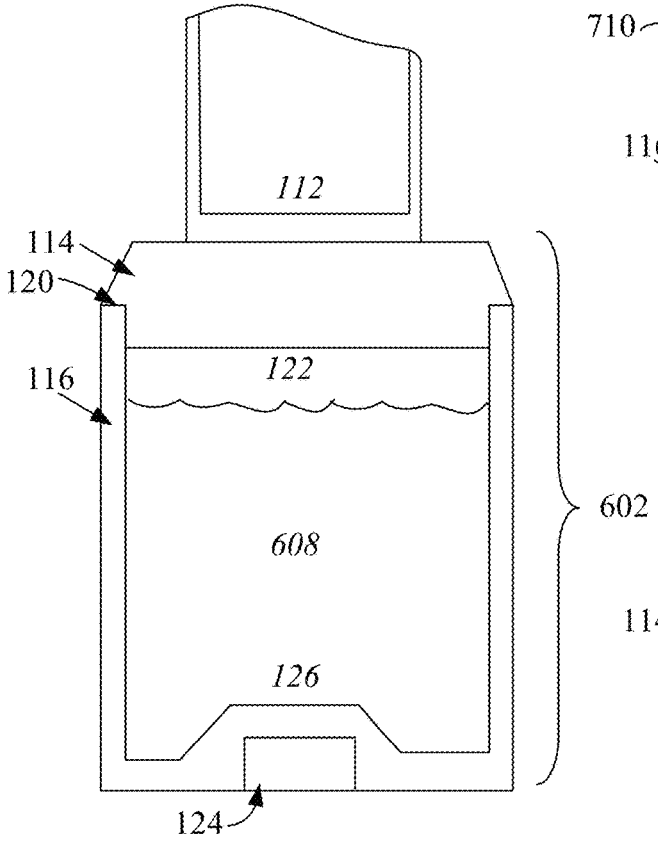
FIG. 6 schematically illustrates the first pod portion and second pod portion fixably attached to form a sealed pod.

In certain embodiments, the first pod portion 114 and second pod portion 116 may fixably attach to each other to form a sealed pod. FIG. 6 schematically illustrates the first pod portion 114 and second pod portion 116 fixably attached to form a sealed pod 602. Here, second pod portion 116 is configured to fixably attach to the first pod 114 portion, for example, by at least one of a screw-fit, a press-fit, or a locking tab. The second pod portion 116 may be pre-filled with a beverage or ingredient for a beverage 608 (e.g., a fluid, powder, syrup, or crystals, etc.).

Figure 7:
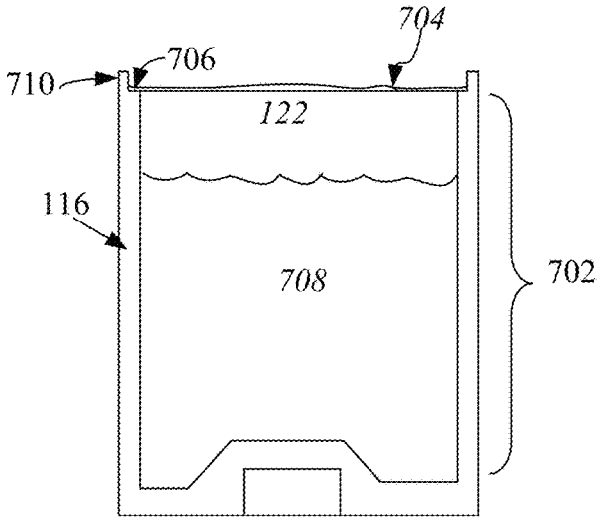
FIG. 7 schematically illustrates the second pod portion having a pre-sealed portion.

In certain embodiments, the second pod portion 116 may be pre-sealed with a beverage ingredient. FIG. 7 schematically illustrates the second pod portion 116 having a pre-sealed portion 702. Here, the second pod portion 116 includes a sealing lid 704 to fixably engage a lip 706 proximal or near the top-drinking end 122 of the second pod portion 116 to seal a mixer 708 within (e.g., a fluid, powder, syrup, or crystal, etc.). The mixer 708 may be carbonated beverage or juice to be combined with the contents 108 in the container 102. The second pod portion 116 may have a portion 710 extending from its elongated body to fixably connect with the first pod portion 114. The sealing lid 704 may be any of various single-use types, such as, for example, a peel-back foil cover or other seals. The sealing lid 704 may be configured for re-use, such as, for example, a locking tab or a screw-fit, to allow for assembly or sealing prior to use.

Figure 8:
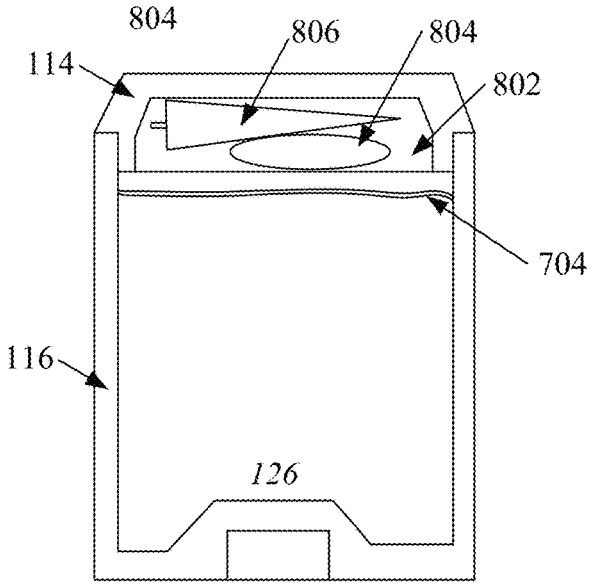
FIG. 8 schematically illustrates the first pod portion as a storage container.

In certain embodiments, the first pod portion 114 may be configured to store one or more ingredients and/or related items for the drink. FIG. 8 schematically illustrates the first pod portion 114 as a storage container. Here, the first pod portion 114 may include a hollow underside cavity 802. The hollow cavity 802 of the first pod portion 114 may house, for example, a sealed packet 804 and/or any of various types of drink-related articles 806, such as a cocktail parasol, garnish (e.g., citrus slice, olives), a napkin or a coaster. The hollow cavity 802 may additionally or alternatively house sanitary-related articles, such as a wet-nap or hand sanitizer. Multiple items may be housed within the sealed pod. It should be apparent to one skilled in the art that the first pod portion 114 may house a packet as the second pod portion 116 houses a sealed fluid. The cavity 802 may be sealed (e.g., using a peel-back foil seal or other seal) and may contain packaged and/or unpackaged items.

Figure 9:
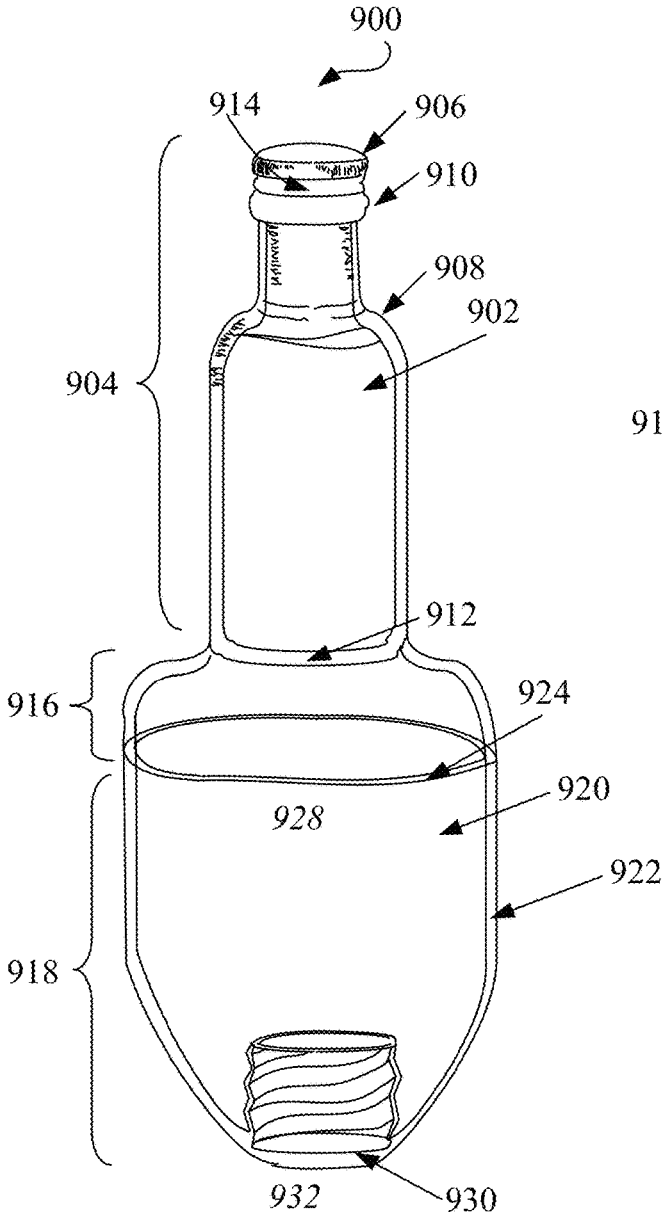
FIG. 9 schematically illustrates a convertible-beverage container and drinking apparatus according to an embodiment.

An exemplary embodiment is now described. FIG. 9 schematically illustrates a convertible-beverage container and drinking apparatus 900 containing a pre-packaged sealed fluid 902, such as may be dispensed in an airplane or other transportation-related setting or at a large crowd setting (e.g., a stadium, a concert hall, or a theme park). The apparatus 900 includes a nip bottle 904 having a sealing cap 906, a fluid-containing elongated body 908, and liquor or alcoholic spirits 902 sealed within. The fluid-containing elongated body 908 has a mouth end 910 oppositely disposed to a base end 912 and forms an orifice 914 at the mouth end 910. The sealing cap 906 fixably engages to the orifice 914 to seal the sealed fluid 902 in the nip bottle 904.

The apparatus also includes a base cover 916 fixably attached to the base end 912. The base cover 916 forms a wider base for the nip bottle 902.

The apparatus 900 also includes a drinking bowl 918 configured to fixably attach to the base cover 916 to from a closed container 920. The base cover 916 and drinking bowl 918 are configured to disengage from each other. The drinking bowl 918 is an elongated body 922 having an open orifice 924 forming a drinking mouth at a top-drinking end 928 and having a screw recess 930 at a bottom end 932 that is oppositely disposed to the top-drinking end 928. The screw recess 930 is configured to fixably engage to the mouth end 910 of the nip bottle 904. The drinking bowl 918 may be shaped with a narrowing bottom for easier assembly with the nip bottle 904.

Figure 10:
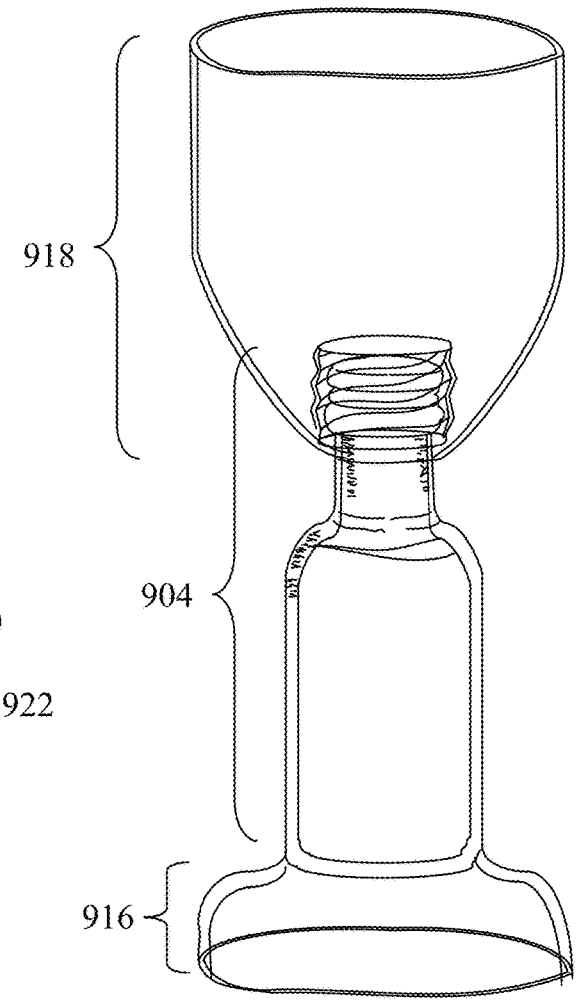
FIG. 10 schematically illustrates the apparatus of FIG. 9 in a converted form.

FIG. 10 schematically illustrates the apparatus of FIG. 9 in a converted form of a drinking vessel, i.e., with the drinking bowl 918 separated from the base cover 916 and attached to the nip bottle to form an article of stemware.

Figure 11:
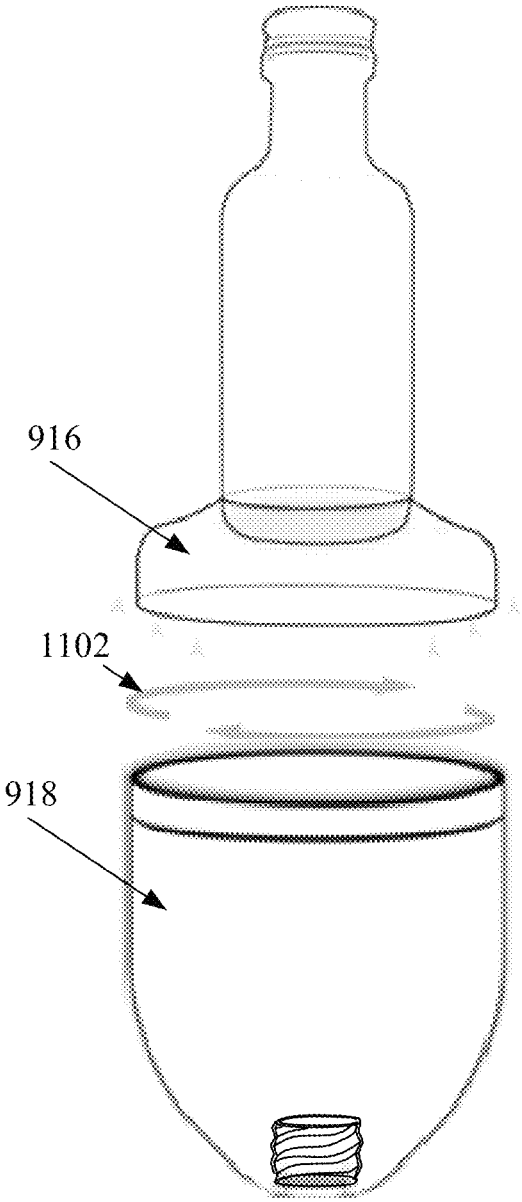
FIG. 11 schematically illustrates a drinking bowl and a base cover of FIG. 9 being disengaged from each other according to an embodiment.

FIG. 11 schematically illustrates the drinking bowl 918 and base cover 916 of FIG. 9 being disengaged 1102 from one other according to one exemplary embodiment.

Figure 12:
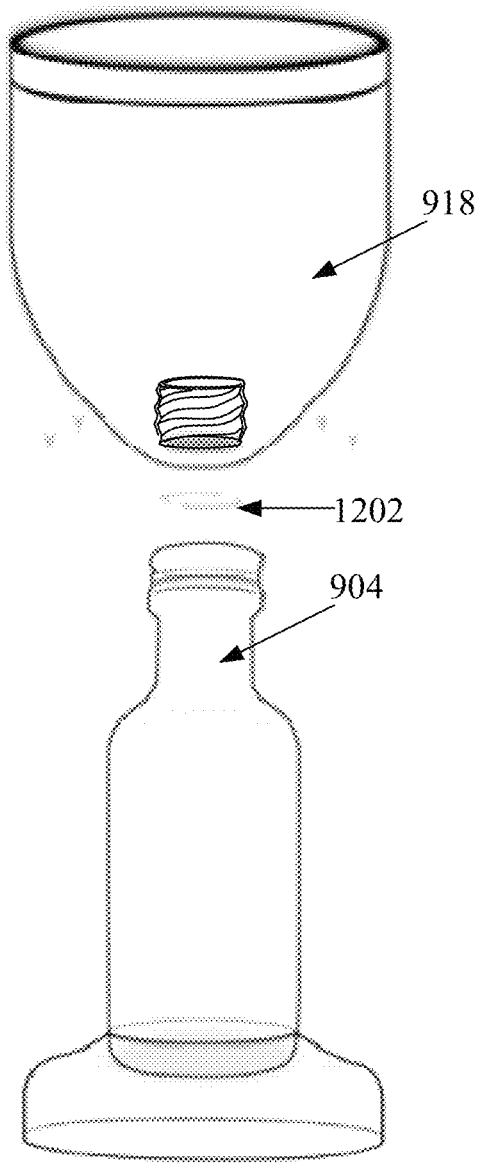
FIG. 12 schematically illustrates the drinking bowl of FIG. 9 prior to being fixably engaged to the nip bottle.

FIG. 12 schematically illustrates the drinking bowl 918 of FIG. 9 prior to being fixably engaged 1202 to the nip bottle 904.

Figure 13:
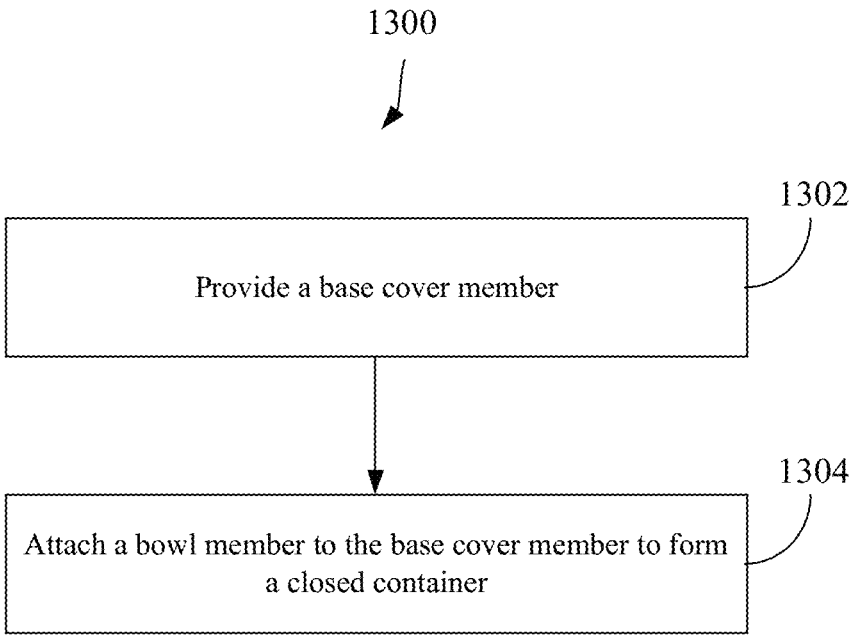
FIG. 13 schematically illustrates a method of manufacturing a convertible beverage container and drinking apparatus.

In another embodiment, a method of manufacturing a convertible beverage container and drinking apparatus having a pre-packaged sealed fluid is provided. FIG. 13 illustrates a method 1300 of manufacturing a convertible beverage container and drinking apparatus. The method includes providing a base cover member, which is configured to fixably attach to a base end of a pre-packaged fluid container (Step 1302). The base cover member may fixably attach to the container at the base end by at least one of press-fitting, adhesives, indentation, ultrasonic welding, and heat fusion. For example, the base cover member may fixably attach to the container 102 by frictional contact. For example, during assembly, the container may be press-fit into a receptacle of the base cover member. In some embodiments, heat may be applied to the base cover member to expand its size by thermal expansion, in which case the container 102 may be pressed into the expanded base cover member, which may be rapidly or allowed to cool to secure the container 102. Alternatively, the base cover member may include a recess portion having compliant fins that are configured to accommodate the base-end of container.

The method also includes attaching a bowl member to the base cover member to form a closed container (Step 1304). The bowl member being an elongated body having an open orifice forming a drinking mouth at a drinking end and having an attachment region oppositely disposed to the drinking end. The attachment region is configured to fixably engage to a mouth end of the pre-packaged fluid container.

Figure 14:
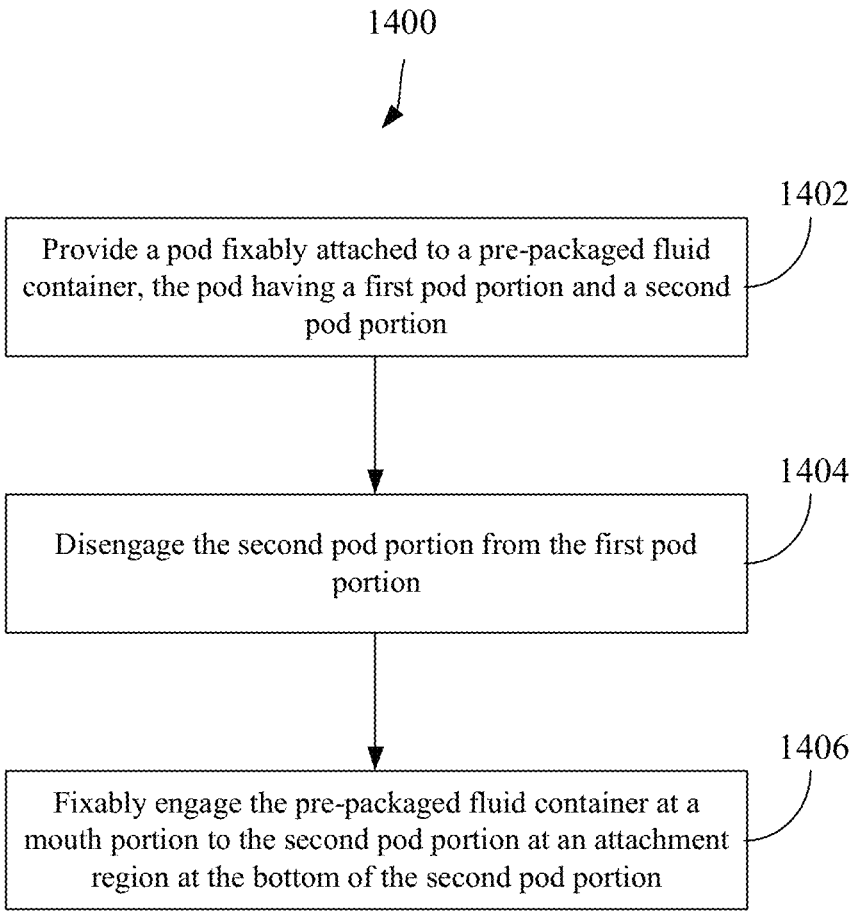
FIG. 14 illustrates a method of converting a convertible beverage container to a drinking apparatus.

In another embodiment, a method of converting a convertible beverage container to a drinking apparatus is provided. FIG. 14 illustrates a method of converting a convertible beverage container to a drinking vessel. The method includes providing a pod fixably attached to a container (Step 1402). The pod may have a first pod portion and a second pod portion fixably attached to one another to form a closed container. The first pod portion and second pod portion are also configured to disengage from one another. The container may have a sealing cap, an elongated body, and an ingredient within the container. The elongated body may have a mouth end oppositely disposed to a base end. The elongated body may form an orifice at the mouth end. The sealing cap may fixably engage to the orifice to seal the sealed ingredient in the container. The first pod portion may form a wider base of the container. The second pod portion may have a second elongated body that forms (i) an open orifice at a drinking end and (ii) an attachment region oppositely disposed to the drinking end. The attachment region may be configured to fixably engage to a mouth end of the container.

The method also includes disengaging the second pod portion from the first pod portion (Step 1404). The method then includes fixably engaging the attachment region of the second pod portion to the mouth end of the container to form the drinking apparatus (Step 1406).

In practice, it is expected that the pod will be manufactured and assembled separately from the container, including, for example, manufacture of the top and bottom portions of the pod (e.g., by a plastics molding manufacturer), any filling and/or sealing of ingredients/items in the top portion and/or bottom portion of the pod (e.g., filling the bottom portion with a mixer such as soda or juice and optionally sealing the bottom portion such as with a peel-back foil seal), and connecting the top and bottom portions. Assembled pods may be distributed separately and/or may be distributed with containers such as nip bottles installed.

For example, one company may sell assembled pods to a liquor company or other vendor that in turn installs containers and sells the pods with containers as a unit to either another vendor or directly to the consumer. Thus, in some embodiments, a vendor (e.g., an airline) may purchase pre-assembled pods from one source, purchase nip bottles of alcohol from another source, and attach the nip bottles to the pre-assembled pods to distribute as a unit. In other embodiments, a liquor distributor may purchase or manufacture pods, attach nip bottles of their own alcohol to the pods, and distribute the pods with containers as a unit.

For another example, a liquor store may sell pods, and customers may purchase a pod along with a nip of alcohol and attach the nip bottle to the pod themselves in order to have a mixed drink in a drinking vessel.

It should be noted that, generally speaking, pods and containers can be combined in a "mix-and-match" fashion. For example, containers of a particular type of alcohol (e.g., vodka, rum, whiskey, etc.) may mate with any of a variety of pods (e.g., vodka containers may mate with pods filled with orange juice, tomato juice, and other vodka-based drink mixers). Also, pods filled with a particular type ingredient (e.g., pods filled with orange juice, sour mix, etc.) may mate with any of a variety of alcohol containers (e.g., pods filled with sour mix may mate with containers filled with vodka, whiskey, melon liquor, or other alcohols that are typically used with sour mix). Thus, a wide variety of mixed drinks can be distributed using a relatively small number of pod types and container types (e.g., five types of pods and five types of alcohol containers can be combined to form 25 types of mixed drinks).

While some exemplary embodiments are described above with reference to a bottle-type container (e.g., a nip bottle) that is attached to the pod and is used as the stem of a stemware beverage vessel, it should be noted that alternative embodiments may use a small can or other type of container. For example, juices (e.g., orange, tomato, pineapple, apple, etc.), energy drinks, and other types of beverage are often available in cans, and the pod can be configured such that the top portion of the pod secures the can and the bottom potion of the pod attaches to the top of the can so that the can forms the stem of the stemware beverage vessel.

While some exemplary embodiments are described above with reference to mixed drinks in which the pod contains a non-alcoholic mixer and the container contains a type of alcohol, it should be noted that pods may contain alcohol and the container may contain a second type of alcohol or a non-alcoholic mixer.

In various alternative embodiments, a two-piece convertible beverage container and drinking apparatus is provided in which the first pod portion 114 is configured to include an attachment element that is similar to the configuration of the top-mouth end of the container 102 or otherwise configured to attach to the attachment region 124 of the second pod portion 116, such that the second pod portion 116 can be attached to the attachment element of the first pod portion 114 to form an article of stemware without use of a separate container 102 such as a nip bottle or can acting as the stem of the article of stemware. Without limitation, some exemplary two-piece embodiments are described below.

In any of the embodiments described herein, including pods described with reference to FIGS. 1-12 or the alternative two-piece embodiments described below, a sealing mechanism can be included to provide a seal between the first pod portion 114 and the second pod portion 116 such as to hold a liquid within the pod during shipment or mixing of a cocktail or to maintain carbonation or freshness of the contents of the pod. Any appropriate sealing mechanism can be included. Without limitation, some exemplary sealing mechanisms are described below.

Figure 15:
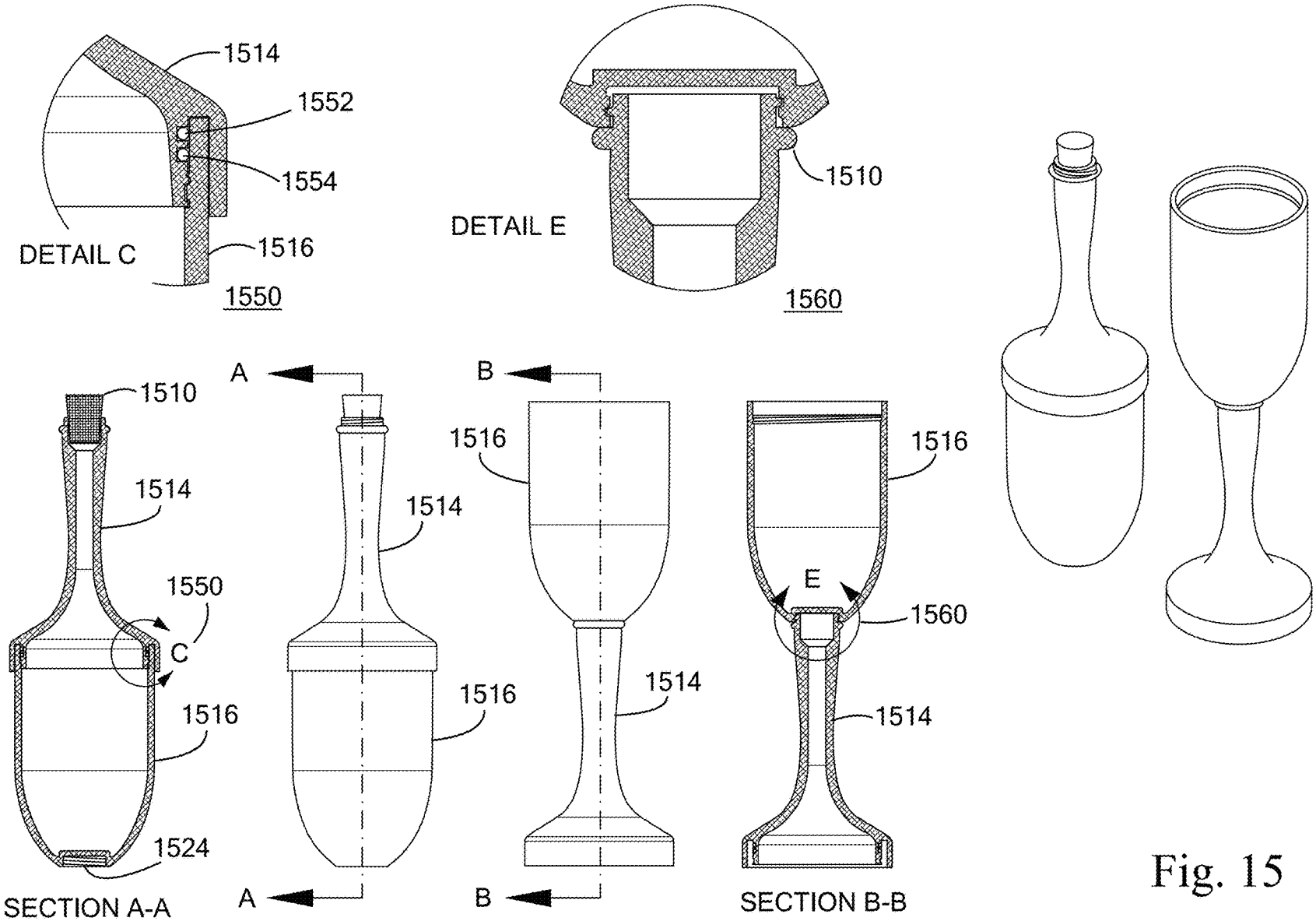
FIG. 15 shows a two-piece convertible beverage container and drinking apparatus, in accordance with a first exemplary embodiment.

FIG. 15 shows a two-piece convertible beverage container and drinking apparatus, in accordance with a first exemplary embodiment. Section A-A shows a cross-sectional view of the first pod portion 1514 attached to the second pod portion 1516 to form an enclosed pod such as for holding a beverage. The first pod portion 1514 has a base element at a base end that is configured to attach to the open orifice at the drinking end of the second pod portion 1516. The first pod portion 1514 includes attachment element 1510 at an attachment end that is configured to attach to attachment region 1524 of the second pod portion 1516. For example, the attachment element 1510 and the attachment region 1524 may include complementary threading or other attachment features. As mentioned above, the first pod portion 1514 and the second pod portion 1516 may be sealed such as to hold a liquid within the pod during shipment or mixing of a cocktail or to maintain carbonation or freshness of the contents of the pod. In this exemplary embodiment, the seal includes two nitrile o-rings 1552 and 1554, as shown in Detail C 1550. In this exemplary embodiment, the first pod portion 1514 includes channels for securing the nitrile o-rings such that the nitrile o-rings contact the second pod portion 1516 when the two pod portions 1514/1516 are attached as shown. Additionally or alternatively, channels can be included in the second pod portion 1516 for securing the nitrile o-rings. It should be noted that one, two, or more o-rings may be used in various alternative embodiments. It also should be noted that other types of o-rings or other types of sealing structures may be used in various alternative embodiments. As discussed above, the first pod portion 1514 can be removed from the second pod portion 1516 and then attached to the second pod portion 1516 to form an article of stemware, for example, as shown in Section B-B. The interconnection of attachment element 1510 to attachment region 1524 is shown in Detail E 1560.

Figure 16:
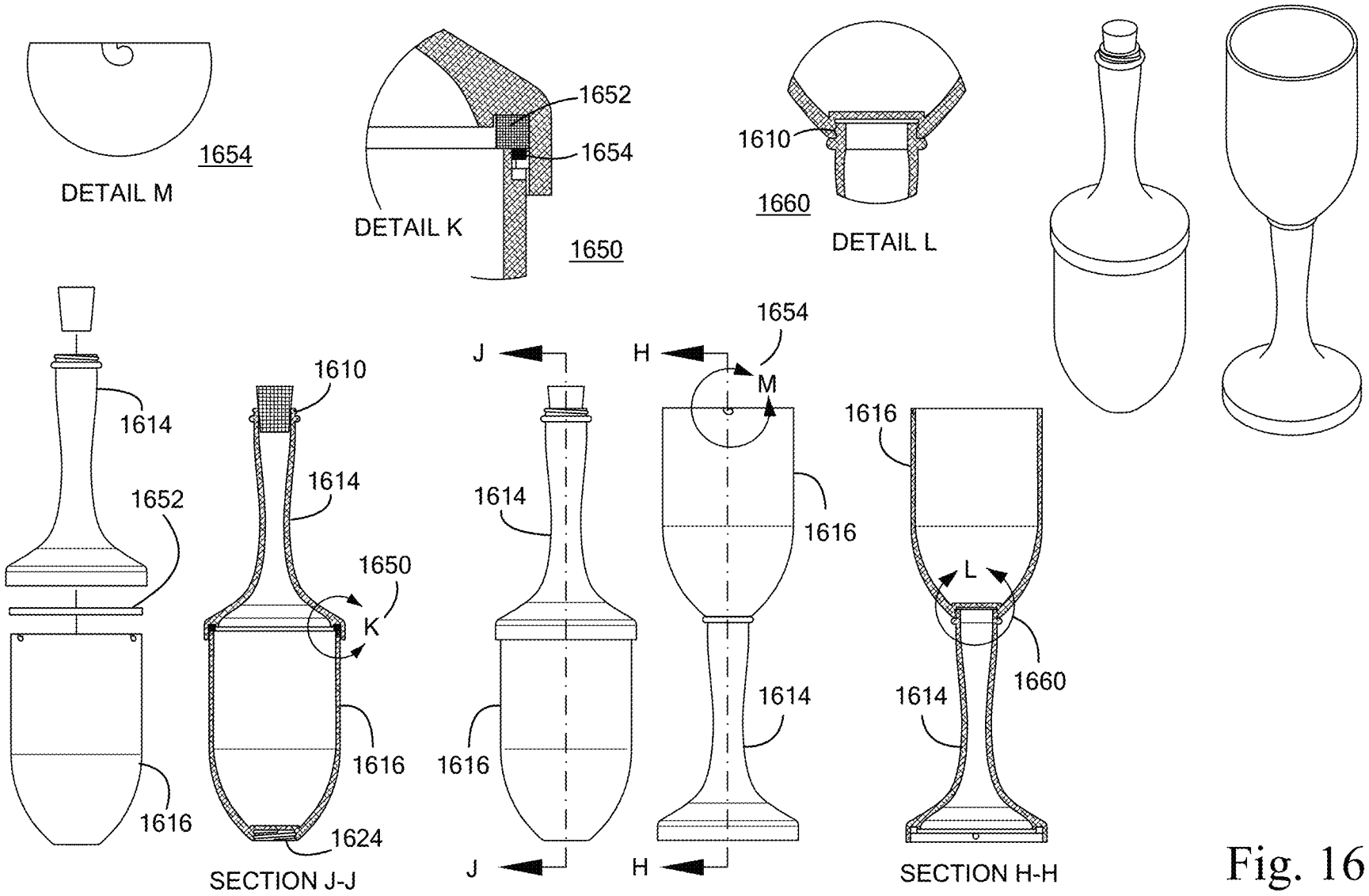
FIG. 16 shows a two-piece convertible beverage container and drinking apparatus, in accordance with a second exemplary embodiment.

FIG. 16 shows a two-piece convertible beverage container and drinking apparatus, in accordance with a second exemplary embodiment. Section J-J shows a cross-sectional view of the first pod portion 1614 attached to the second pod portion 1616 to form an enclosed pod such as for holding a beverage. The first pod portion 1614 has a base element at a base end that is configured to attach to the open orifice at the drinking end of the second pod portion 1616. In this exemplary embodiment, the second pod portion 1616 includes locking pins 1654 that mate with corresponding locking features on the first pod portion 1614 to allow the first pod portion 1614 to be attached and detached from the second pod portion 1616. The first pod portion 1614 includes attachment element 1610 at an attachment end that is configured to attach to attachment region 1624 of the second pod portion 1616. For example, the attachment element 1610 and the attachment region 1624 may include complementary threading or other attachment features. As mentioned above, the first pod portion 1614 and the second pod portion 1616 may be sealed such as to hold a liquid within the pod during shipment or mixing of a cocktail or to maintain carbonation or freshness of the contents of the pod. In this exemplary embodiment, the seal includes a cork gasket 1652 that is positioned between the first pod portion 1614 and the second pod portion 1616, as shown in Detail K 1650. It should be noted that other types of gaskets (e.g., rubber or nitrile) or sealing structures may be used in various alternative embodiments. As discussed above, the first pod portion 1614 can be removed from the second pod portion 1616 and then attached to the second pod portion 1616 to form an article of stemware, for example, as shown in Section H-H. The interconnection of attachment element 1610 to attachment region 1624 is shown in Detail L 1660.

Figure 17:
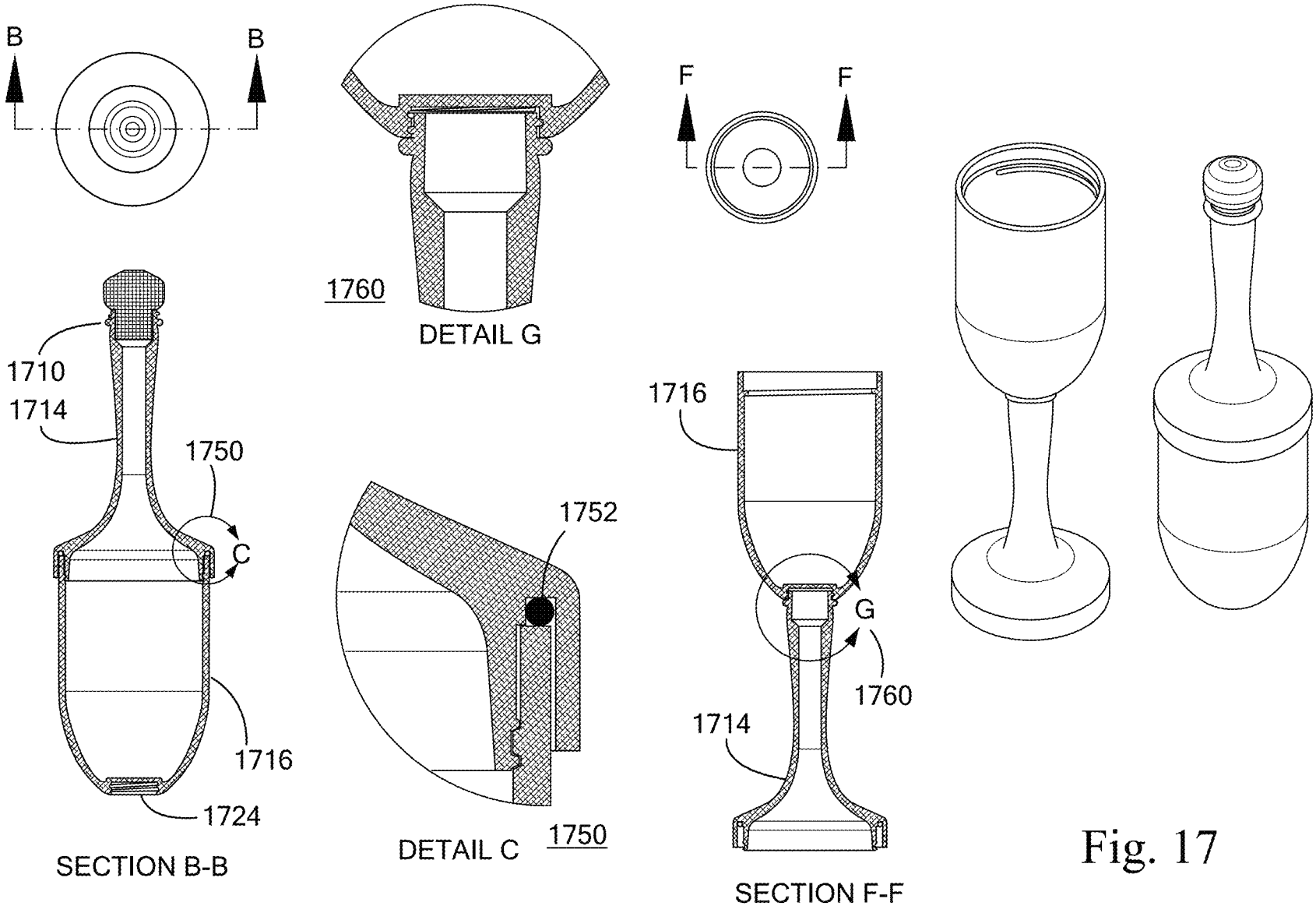
FIG. 17 shows a two-piece convertible beverage container and drinking apparatus, in accordance with a third exemplary embodiment.

FIG. 17 shows a two-piece convertible beverage container and drinking apparatus, in accordance with a third exemplary embodiment. Section B-B shows a cross-sectional view of the first pod portion 1714 attached to the second pod portion 1716 to form an enclosed pod such as for holding a beverage. The first pod portion 1714 has a base element at a base end that is configured to attach to the open orifice at the drinking end of the second pod portion 1716. The first pod portion 1714 includes attachment element 1710 at an attachment end that is configured to attach to attachment region 1724 of the second pod portion 1716. For example, the attachment element 1710 and the attachment region 1724 may include complementary threading or other attachment features. As mentioned above, the first pod portion 1714 and the second pod portion 1716 may be sealed such as to hold a liquid within the pod during shipment or mixing of a cocktail or to maintain carbonation or freshness of the contents of the pod. In this exemplary embodiment, the seal includes an o-ring 1752 that is positioned between the first pod portion 1714 and the second pod portion 1716, as shown in Detail C 1750. It should be noted that other types of gaskets (e.g., cork) or sealing structures may be used in various alternative embodiments. As discussed above, the first pod portion 1714 can be removed from the second pod portion 1716 and then attached to the second pod portion 1716 to form an article of stemware, for example, as shown in Section F-F. The interconnection of attachment element 1710 to attachment region 1724 is shown in Detail G 1760.

Also as discussed above, the second pod portion 1516/1616/1716 can include a beverage or an ingredient for a beverage (e.g., a liquid or other ingredient), and a removable seal such as seal 704 can be included to seal the ingredient within the second pod portion 1516/1616/1716. Such a removable seal can be used in combination with, or in lieu of, seals such as o-rings or gaskets, in various alternative embodiments.

Also as discussed above, the first pod portion 1514/1614/1714 can include a hollow cavity. The hollow cavity can be used to contain an ingredient for the beverage, a drink-related article, a sanitary-related article, or other item. Alternatively, as shown in FIGS. 15-17, the first pod portion 1514/1614/1714 can include an opening at the attachment end (i.e., the end including attachment element 1510/1610/1710) through which a liquid or other ingredient can be poured into the pod and then sealed (e.g., using a cork or screw-on top) and through which contents of the pod can be dispensed if needed. Thus, for example, the pod can be assembled and then filled with one or more ingredients for a beverage.

The present invention may be embodied in other specific forms without departing from the true scope of the invention, and numerous variations and modifications will be apparent to those skilled in the art based on the teachings herein. Any references to the "invention" are intended to refer to exemplary embodiments of the invention and should not be construed to refer to all embodiments of the invention unless the context otherwise requires. The described embodiments are to be considered in all respects only as illustrative and not restrictive.

What is claimed is:

1. A convertible beverage container and drinking apparatus, the convertible beverage container and drinking apparatus comprising:

a first pod portion having a base element at a base end, a stem element extending from the base element, and an attachment element at an attachment end of the stem element oppositely disposed to the base end; and a second pod portion having an open orifice at a drinking end, the open orifice configured to fixably attach directly to the base element at the base end of the first pod portion, and an attachment region oppositely disposed to the drinking end, the attachment region configured to fixably attach to the attachment element at the attachment end of the stem element of the first pod portion; and at least one seal, wherein the first and second pod portions are configured to alternately form (a) a pod configuration in which the second pod portion is at a bottom of the apparatus, the first pod portion is at a top of the apparatus, and the base element at the base end of the first pod portion is fixably attached directly to the open orifice at the drinking end of the second pod portion with the at least one seal disposed between the first and second pod portions to form a seal therebetween and (b) a stemware configuration in which the first pod portion is at the bottom of the apparatus, the second pod portion is at the top of the apparatus, and the attachment element at the attachment end of the stem element of the first pod portion is fixably attached to the attachment region of the second pod portion to form a stemware drinking vessel having a foot, a stem, and a bowl in which the base element of the first pod portion forms the foot of the stemware drinking vessel, the stem element of the first pod portion is the stem of the stemware drinking vessel, and the second pod portion forms the bowl of the stemware drinking vessel.

2. The apparatus of claim 1, wherein, in the pod configuration, the second pod portion contains a beverage or an ingredient for a beverage.

3. The apparatus of claim 2, wherein the beverage or ingredient is a liquid.

4. The apparatus of claim 2, wherein the second pod portion further includes a removable seal to hold the ingredient in the second pod portion.

5. The apparatus of claim 1, wherein the first pod portion includes a hollow cavity containing at least one of (1) an ingredient for the beverage, (2) a drink-related article, or (3) a sanitary-related article.

6. The apparatus of claim 1, wherein the first pod portion and the second pod portion are plastic.

7. The apparatus of claim 1, wherein the second pod portion is configured to fixably attach to the first pod portion by at least one of a screw-fit, a press-fit, a snap-fit, or a locking tab.

8. The apparatus of claim 1, wherein the at least one seal includes at least one o-ring.

9. The apparatus of claim 1, wherein the at least one seal includes at least one gasket.

10. The apparatus of claim 9, wherein the at least one gasket includes a cork gasket.

11. The apparatus of claim 1, further comprising a cork or cap to seal an opening at the attachment end of the first pod portion in the pod configuration.

12. The apparatus of claim 1, wherein, in the pod configuration, the first pod portion includes an opening at the attachment end in fluid communication with the open orifice of the drinking end of the second pod portion to form a hollow cavity within the pod.

13. The apparatus of claim 12, further comprising contents within the hollow cavity of the pod.

14. The apparatus of claim 13, wherein the contents are filled into the hollow cavity through the opening at the attachment end of the first pod portion.

15. The apparatus of claim 13, where the contents are pre-filled in the second pod portion prior to attachment of the base element of the base end of the first pod portion to the open orifice at the drinking end of the second pod portion to form the pod.

16. The apparatus of claim 13, further comprising a seal at the opening of the attachment end of the first pod portion to contain the contents within the pod.

17. The apparatus of claim 16, wherein the seal at the opening of the attachment end of the first pod portion includes a cork.

18. The apparatus of claim 16, wherein the seal at the opening of the attachment end of the first pod portion includes a cap.

19. The apparatus of claim 16, wherein the seal at the opening of the attachment end of the first pod portion is configured to contain a liquid within the pod.

20. The apparatus of claim 16, wherein the seal at the opening of the attachment end of the first pod portion is configured to contain pressure of the contents within the pod.

21. The apparatus of claim 16, wherein the seal at the opening of the attachment end of the first pod portion is configured to maintain carbonation of the contents of the pod.

22. The apparatus of claim 16, wherein the contents include a carbonated beverage.

23. The apparatus of claim 22, wherein the carbonated beverage includes champagne or other sparkling wine or alcoholic beverage.

24. The apparatus of claim 16, wherein the seal at the opening of the attachment end of the first pod portion is configured to maintain freshness of the contents of the pod.

25. The apparatus of claim 1, wherein the bowl of the second pod portion is shaped as a bowl portion of a champagne flute and wherein the stemware configuration forms a champagne flute and the pod configuration forms a champagne bottle.

26. The apparatus of claim 1, wherein the bowl of the second pod portion is shaped as a bowl portion of a wine glass and wherein the stemware configuration forms a wine glass and the pod configuration forms a wine bottle.

* * * * *